United States Patent [19]

Spradlin

[11] 4,257,178

[45] Mar. 24, 1981

[54] HEIGHT ADJUSTABLE DRUM TYPE DREDGING APPARATUS

[76] Inventor: Shelby L. Spradlin, 424 Wolf's Neck Trail, Virginia Beach, Va. 23452

[21] Appl. No.: 100,075

[22] Filed: Dec. 4, 1979

[51] Int. Cl.[3] ..... E02F 3/18

[52] U.S. Cl. ..... 37/70; 37/189

[58] Field of Search ..... 37/70, 66, 91, 94–97, 37/189, 190

[56] References Cited

U.S. PATENT DOCUMENTS

| | | | |
|---|---|---|---|
| 1,196,426 | 8/1916 | Bowling | 37/70 |
| 1,448,579 | 3/1923 | Tideman | 37/91 |
| 3,230,647 | 1/1966 | Gates | 37/190 |
| 3,896,571 | 7/1975 | Satterwhite | 37/190 |

*Primary Examiner*—Clifford D. Crowder

*Attorney, Agent, or Firm*—Sughrue, Rothwell, Mion, Zinn and Macpeak

[57] ABSTRACT

A cylindrical drum is mounted for rotation about its axis on laterally opposed horizontal crossbeams of an open rectangular frame which crossbeams, in turn, bear on at least one end thereof, lift beams, slidable within vertical guide rails for varying the vertical height of each crossbeam and its drum relative to a barge supporting the dredging apparatus. A plurality of closely spaced radially directed pairs of guide plates extend outwardly from the axis of the drum to the drum outer periphery at given drum slots, permitting the projection of blade assemblies radially from the drum periphery. Each blade assembly includes a planar blade member bearing elongated rectangular bucket cut-out areas. To the opposite edges of the cut-out areas are hinge-mounted, interengaging main and auxiliary bucket plates which overlie each other when closed and which open to form generally right angle troughs or buckets. The plates are forced radially outwardly of the drum slots at the bottom of the drum rotation to dredge material from the sea bottom. They are closed by arcuate cams near the top of the drum rotation, forcing the dredged material to slide over an arcuate dredge ramp and into a transverse chute for dredge material removal laterally to one side or the other of the rotating drum.

10 Claims, 9 Drawing Figures

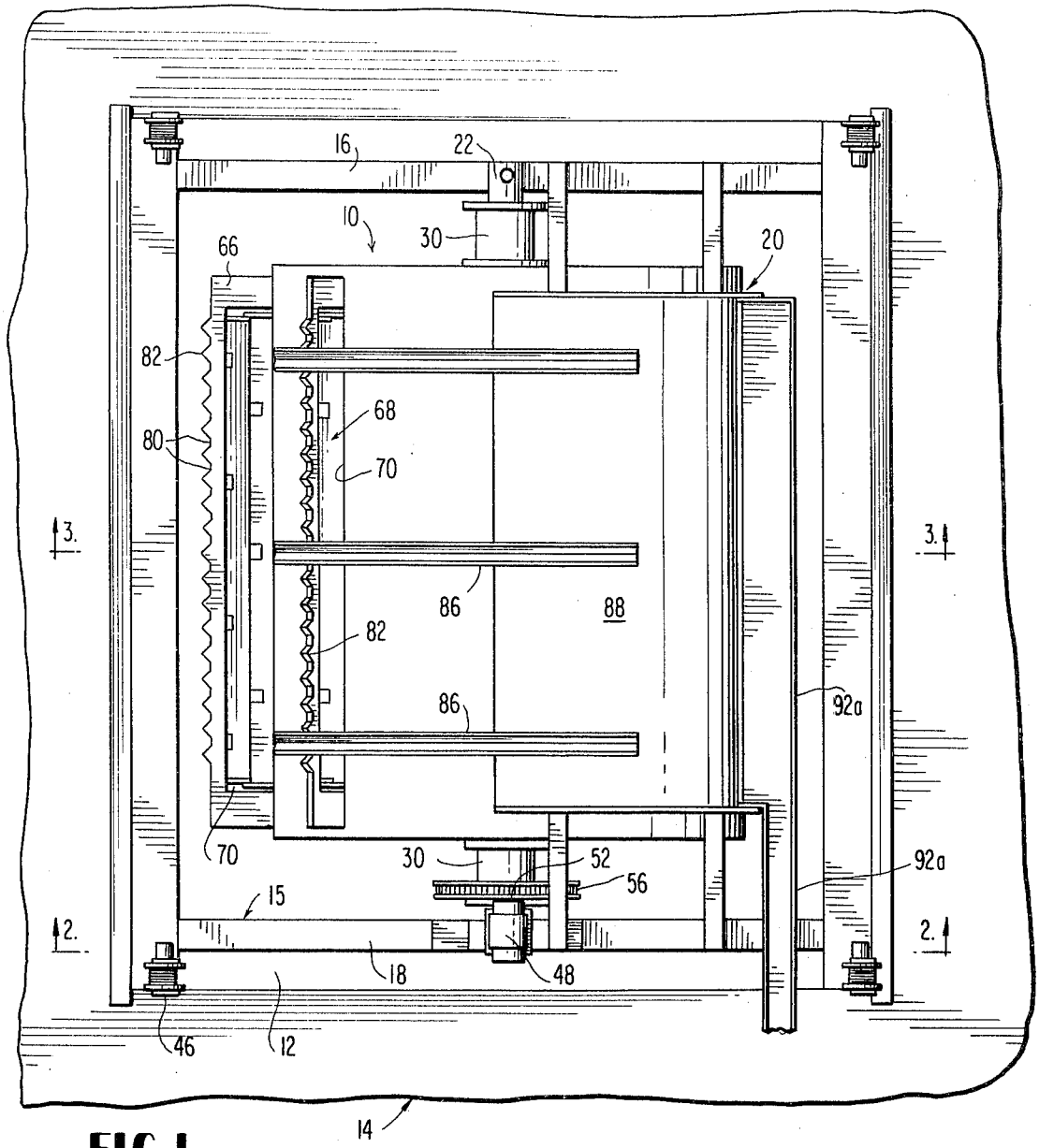
FIG. 1
FIG. 9
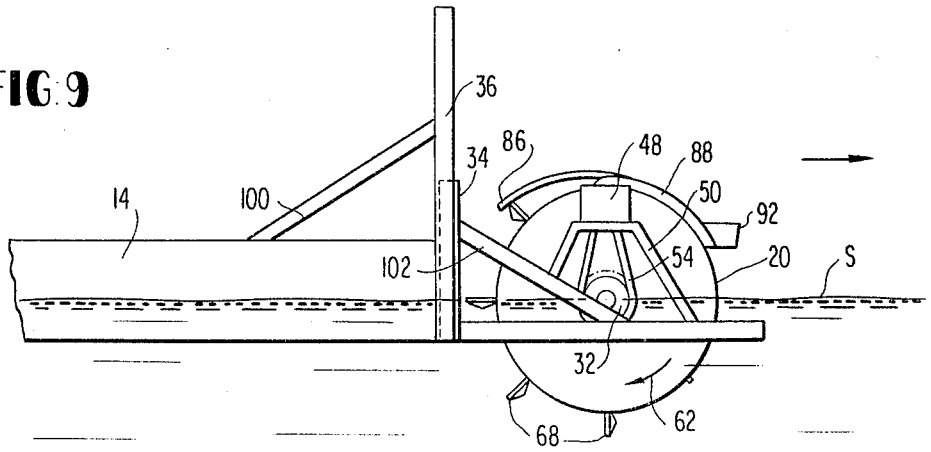

HEIGHT ADJUSTABLE DRUM TYPE DREDGING APPARATUS

FIELD OF THE INVENTION

This invention relates to dredging apparatus and, more particularly, to dredging apparatus constituted by a rotating drum bearing a plurality of dredging blades which are forced to move in and out relative to the drum periphery and to effect automatically loading of the blades during a portion of the drum rotation and discharge of the dredge material captured thereby during another portion of the drum rotation.

BACKGROUND OF THE INVENTION

The basic principle of employing a barge for mounting a cylinder rotating about a horizontal axis, which cylinder bears pivotable elements defining scoops or buckets and which acts to pick up dredge material beneath the water surface and then causing as the dredge material on the scoops moves out of the water to fall onto an inclined ramp which, in turn, acts as a chute to guide the dredge material to an accumulatin means, is found within U.S. Pat. No. 10,668 to Lyons issuing Mar. 21, 1854.

Further, the utilization of eccentric means for such buckets or scoops to cause them to project at one point during the rotation of a drum or cylinder, so as to effect scooping of the dredge from the floor of the sea bed underlying the barge and then to retract inwardly of the cylinder or drum as the buckets rotate on the drum to another point where the dredge is discharged, is exemplified by U.S. Pat. No. 1,196,426 to Bowling.

However, while such techniques have been employed in dredging machines over the past century, the apparatuses have not been very effective in operation. The scoops do not always automatically move freely into and out of the drum periphery to achieve the initial collection of dredge from the sea bed and the transfer of that dredge material from the drum periphery to a removal chute, ramp or the like in an adequate and efficient manner. Further, such machines have been complicated in structure and have been unable to adequately adjust to the varying dredge conditions, terms of compactness or density of the material being dredged or the depth to which dredging must occur.

It is, therefore, a primary object of the present invention to provide an improved dredging machine of this type which obviates the problems outlined above and in which the mechanism is simple in construction, wherein the submergence of the dredging drum may be readily varied and wherein the apparatus is equally capable of being borne by the barge at an intermediate barge position or at a forward end of the same.

SUMMARY OF THE INVENTION

The invention constitutes a rotary drum type dredging apparatus which is barge mounted, the barge supporting an open rectangular frame bearing a drum mounted for rotation horizontally about its axis with the lower end of the drum immersed within the sea. Projectable and retractable dredging blades extend longitudinally of the drum at circumferentially spaced positioned, the ends of the blades being projectable from the drum periphery beneath the water to cut into the underlying sea bed. The drum is rotated in the direction of barge movement. Each blade bears an elongated rectangular slot within which are hinge-mounted a pair of oppositely directed elongated rectangular bucket plates. Means loosely link the bucket plates at their free edges with the bucket plates moving from positions where the plates overlie each other to close off the slot to positions where the bucket plates are generally at right angles to form an open bucket.

BRIEF DESCRIPTION OF THE DRAWINGS

FIG. 1 is a top plan view of the improved rotary drum type dredging apparatus forming one embodiment of the present invention as mounted intermediate of the ends of a marine barge.

FIG. 9 is a schematic side elevational view of a second embodiment of the invention with the dredge apparatus mounted to the front end of a barge.

DESCRIPTION OF THE PREFERRED EMBODIMENTS

Figure 2:
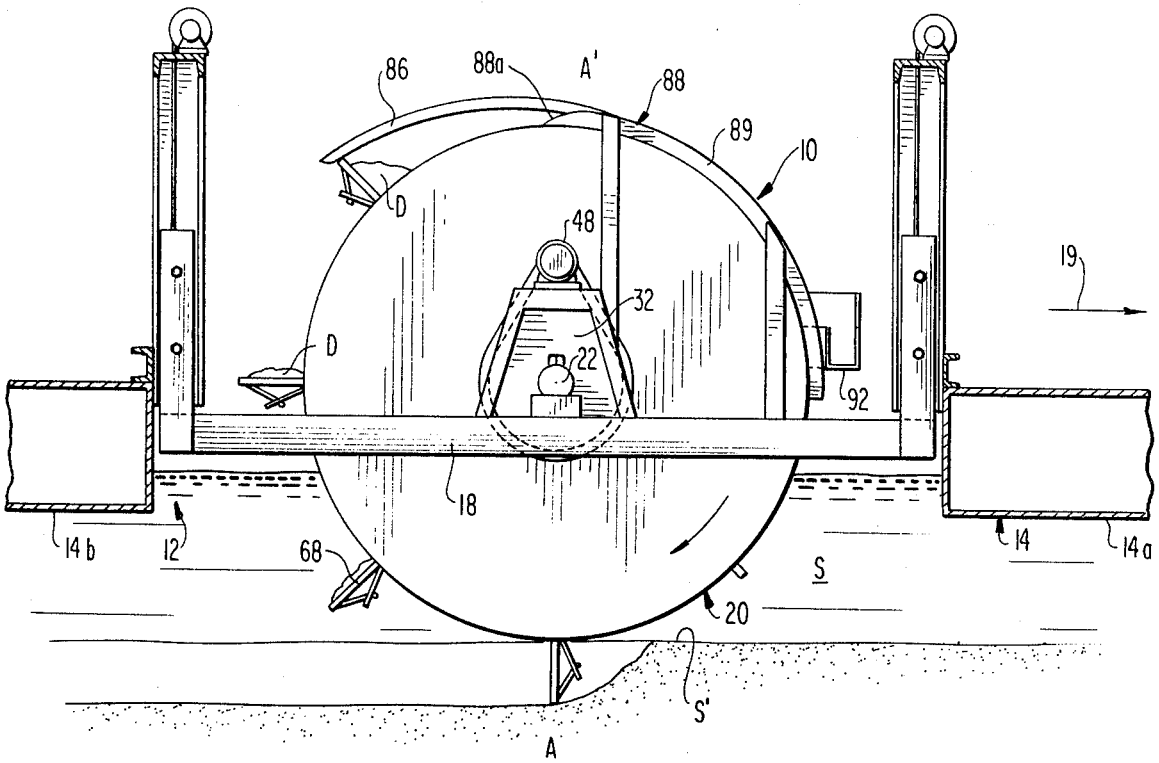
FIG. 2 is a vertical sectional view of the apparatus of FIG. 1 taken about line 2—2.
Figure 5:
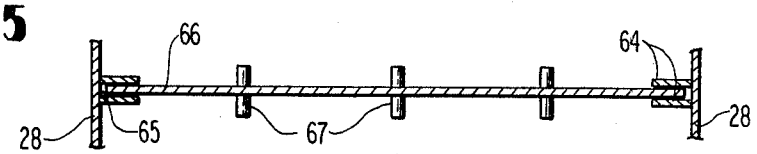
FIG. 5 is a horizontal sectional view of a portion of the apparatus as shown in FIG. 4 taken about line 5—5.

Referring to FIGS. 1–8 inclusive, there is shown a preferred embodiment of the rotary drum type dredging apparatus of the present invention indicated generally at 10 and being mounted within a preformed rectangular opening or hole 12 within the deck of a floating marine barge, indicated generally at 14, said opening 12 being positioned intermediate of the bow and stern portions of that vessel. The dredging apparatus 10 takes the form of laterally opposed left and right crossbeams 16 and 18, extending almost the full length of opening 12 between the front portion **14*a* of the barge 14 and a rear portion 14*b*. Crossbeams 16 and 18 are joined at their ends by right angle end beams 17 to form an open rectangular frame 15. The barge 14 is moving from left to right in FIG. 2, as indicated by arrow 19. The crossbeams 16 and 18 support a large diameter drum indicated generally at 20 for rotation about a horizontal axis of the drum 20, the drum 20 being supported for rotation by means of stub axles 22 which are borne suitably by axle mounts 24, the axles 22 being stationary and passing through openings 26 formed within the drum sidewalls as at 28. The drum 20 may be constructed of metal, as are the other components of the apparatus. A large diameter drum cylinder 29 extends between sidewalls 28** to complete the drum.

The drum 20 rotates about the common axis of the axles 22 on paired sleeve bearings as indicated at 30, one of the sleeve bearings further comprising a driven sprocket indicated at 32. Opposite ends of the crossbeams 16 and 18 in the embodiment of FIGS. 1 to 8 inclusive are provided vertical lift beams 34 of similar size, being welded thereto. The lift beams 34 ride within vertical guide rails 36 which are fixed to forward and aft barge portions 14*a* and 14*b*, respectively, by suitable C-beams 38. The rails 36 are welded to the C-beams 38, and the C-beams 38 are welded to the deck of the barge 14. Each lift beam 34 is provided with one or more holes as at 40 and similarly the rails 36 are provided with a series of vertical aligned holes 40' within which are positioned bolts as at 42, FIG. 3. The bolts 42 act to lock the lift beams 34 at a desired vertical height relative to the barge 14.

In order to lift the drum 20 and to vary the vertical height of the axis of rotation of the drum 20 and immersion of the drum 20 within the sea S, each of the lift beams 34 is connected at its upper end by means of a cable as at 44, to a suitable motor driven winch 46, such that by operation of the winches 46, the dredging apparatus 10 as a unit can be lifted or lowered relative to the barge 14 which bears the same and thus being capable of varying the dredging depth of the individual blade assemblies carried by drum 20. While the winches 46 are illustrated as motor driven winches, they obviously can be manually driven. Alternatively, all of the lift beams can be coupled by means of individual cables to a single winch for simultaneously winching the lift beams 34 through a single drive mechanism.

Figure 3:
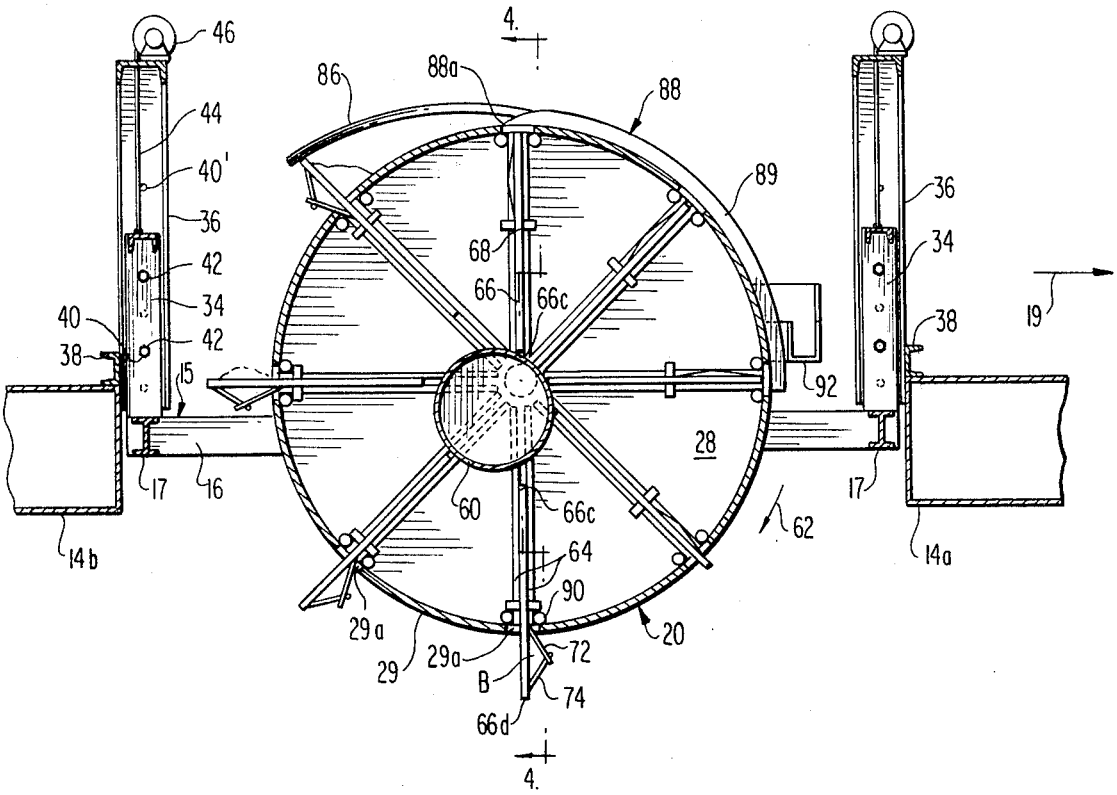
FIG. 3 is a vertical sectional view of the apparatus shown in FIG. 1, taken about line 3—3.
Figure 4:
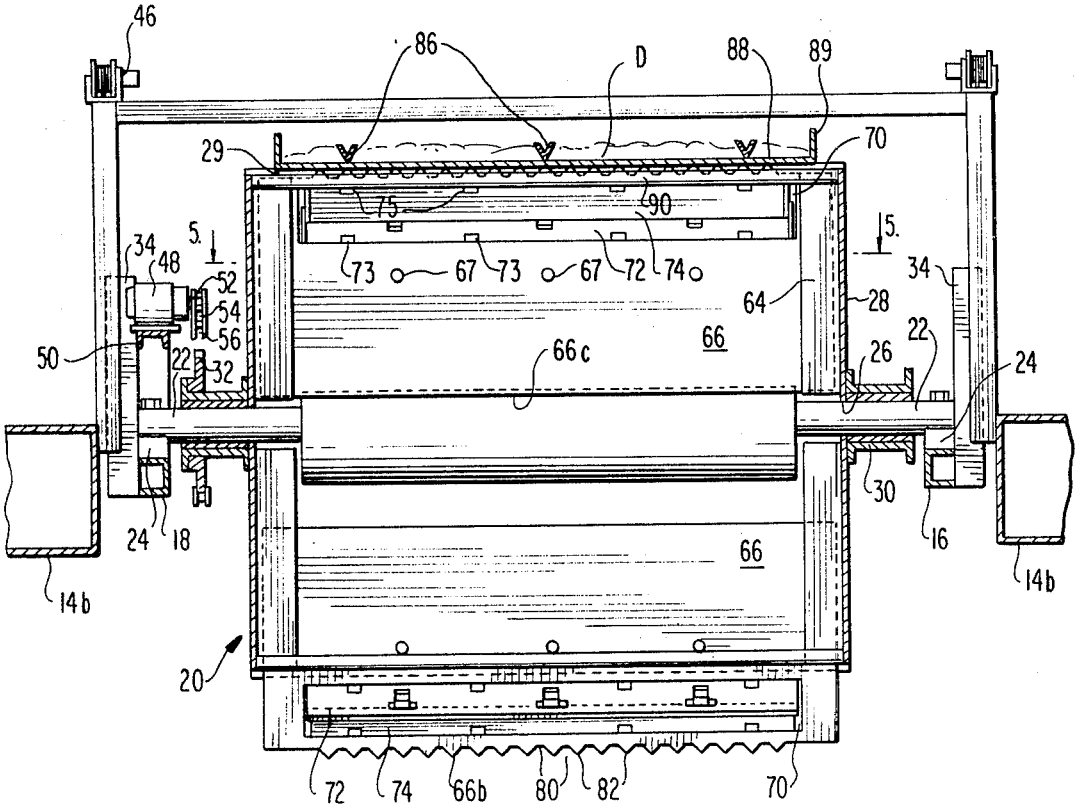
FIG. 4 is a vertical sectional view of the apparatus as shown in FIG. 3 taken about line 4—4.

With respect to the drum 20, it may be driven as exemplified in FIG. 4 by a drum drive motor 48 which is mounted above the crossbeam 16 on a support assembly 50 which extends upwardly from the crossbeam 16. The drive motor 48 overlies one stub axle 22 and its sprocket 32. The drive motor 48 terminates in a shaft 52 bearing a small diameter drive motor sprocket 54 and a chain 56 links the drive motor sprocket 54 to drum shaft sprocket 32 borne by a bearing 30. Instead of a separate drive motor for the drum 20, a single motor may be employed to drive the drum and also to lift the lift beams 34, if desired. In the arrangement illustrated in FIGS. 1–8, the drum 20 is lifted independently of the mechanism for driving the drum, and regardless of the vertical height of the drum, it may be readily driven without any changes due to the constant connection between the drum drive motor 48 and its sprocket 54 and the sprocket 32 on the bearing which rotatably supports the drum 20 relative to the fixed stub axles 22. Preferably, it is desired that the axles 22 be fixed, since internally of the drum cylinder 29 is positioned a second, much smaller camming cylinder 60 whose ends are fixed to the stub axles 22, and which, as shown in FIG. 3, is positioned eccentric to the drum cylinder 29 and mostly within the rear, lowermost quadrant of drum rotation as indicated by arrow 62, FIG. 3. Also mounted internally of the drum 20 and adjacent respective sidewalls 28 are laterally opposed, closely spaced pairs of guide plates as at 64 which are of a given width and define longitudinally spaced parallel guide slots for individual blades 66 forming the principal component of the blade assemblies 68 from the drum 20. The camming cylinder 60, as seen in FIG. 4, is of an axial length which is less than the axial length of the large drum cylinder 29. The guide plates 64 extend radially the full extent of the drum interior from the stub axles 22 to the outer drum cylinder 29. In turn, each individual blade 66 of the blade assemblies 68 is of a length slightly less than the distance between the side plates 28 of the drum 20, so that the edges of the blades 66 are at all times maintained in proper axial position but permitted to slide radially within the guide slots 65 defined by the spaced parallel guide plates 64 at each end of the drum 20, FIG. 5.

The nature, make up and operation of the remaining components of each blade assembly 68 may be further appreciated by reference to FIGS. 3, 4, 7 and 8. Each blade is provided with a rectangular elongated bucket holding slot 70, FIG. 4, within which are hinge-mounted a main or primary bucket plate 72 having a width which is approximately equal to the width of the slot 70 and an auxiliary or secondary bucket plate 74 which is of much shorter width, although extending the longitudinal length of the slot 70 as does main bucket plate 72. The main bucket plate 72 is hinged at 73 to the radially inner edge (closest to the cylinder 60) of blade 66 at the opening or slot 70 and extends and spans approximately 98% of the slot, while the auxiliary or secondary bucket plate 74 is hinged to the radially outer edge 66*b* of the slot 70 and extends approximately 60% across the slot 70 in the direction of the cylinder 60.

In the direction of rotation of drum 20, as per arrow 62, plate 74 overlies main bucket plate 72. Further, the main bucket plate 72 has a plurality of transverse slots 76 through which project at each location, arms 78 mounted to bucket plate 74 and bearing rolling pins 80 on the ends thereof which overlie portions of the main bucket plate 72 to opposite sides of the slot 76, forming a loose linkage therebetween. Thus, since the bucket plates 72 and 74 are rotatably mounted to the blade 66 at inner and outer edges of the slots 70, as at 66*a* and 66*b* of the blade 66, by way of hinges 73 and 75, respectively, the bucket plates 72 and 74 are free to pivot on blade 66 controlled by the arms 78 and the rolling pins 80.

Figure 6:
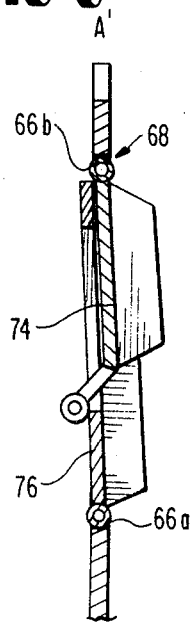
FIG. 6 is a sectional view of one of the blade assemblies of the drum forming a part of the apparatus of FIG. 1 in blade retracted position when in its vertically uppermost position, as viewed in FIG. 3.
Figure 7:
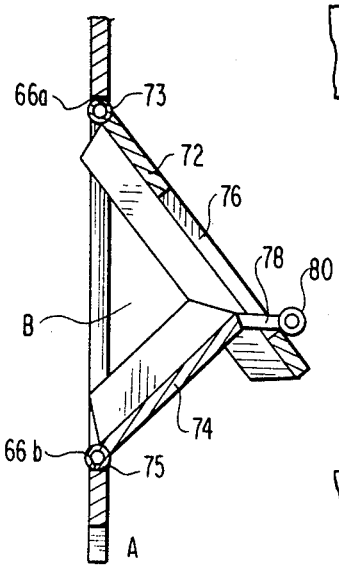
FIG. 7 is a similar vertical sectional view of the same blade assembly in blade projected position in its lowermost vertical position, as seen in FIG. 3.
Figure 8:
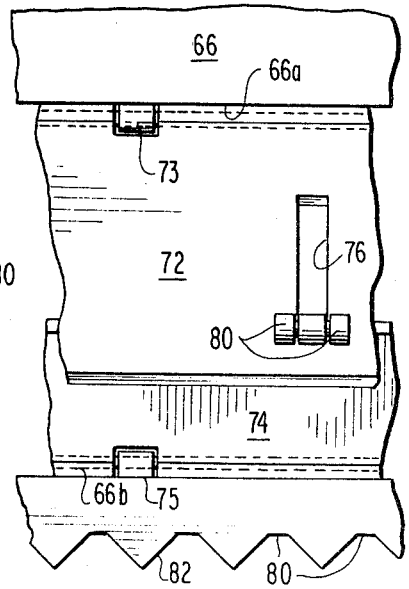
FIG. 8 is a rear view of a portion of the blade assembly of FIG. 7 in full extended, bucket forming position.

In FIGS. 6 and 7, the bucket plates 72 and 74 may move from closed positions where they are parallel and in flat surface contact with each other to open positions where they are essentially at right angles to each other to form buckets B. Thus, in FIG. 7, they define scooping or dredging buckets for dredge material scraped from the sea bottom S' during operation, FIG. 2. The dredge material D, FIG. 2, is maintained within the buckets B during rotation from position A where the blade assembly 68 is fully extended and vertically straight down, FIG. 2, to position A' where it is retracted and straight up, above the axis of drum rotation to force the dredge material D against the periphery of the drum cylinder 29 as the blade assemblies move to their uppermost positions during rotation of drum 20. It may be appreciated that each of the blade assemblies while permitted to fall by gravity operation to their lowermost position, as per FIG. 3, are forcibly assisted to move into a retracted position, also achieved by gravity as the blade assemblies move to their uppermost positions in terms of rotative travel. The effect of this may be readily seen in the vertical sectional view of FIG. 4, in which the uppermost blade assembly 68 is at its radially inner or retracted position, with edge 66*c* of the blade 66 in contact with the periphery of cylinder 60 and the lowermost blade assembly having its one edge 66*c* remote from the periphery of that cylinder 60 and with the buckets and plates 72 and 74 generally at right angles to each other.

While the blades are shown as straight, they may be of one piece metal, slightly curved on one edge to enable the blade to dig. As evidenced particularly in FIG. 4, the radially outer edge 66*d* of the blade 66 is provided with gaps or cut outs as at 80 forming teeth 82 to permit the leading edge 66*d* of the blade to bite into the sea bottom S', FIG. 2.

As may be further appreciated in FIG. 3, the blade 66 is forced by cylinder 60 out of the large drum cylinder 29 as the drum 20 rotates, the cutting edge 66*b* digging into the soil as it is rotated. The dredge material D tends to open the bucket B automatically and to fill the bucket, FIG. 7. The dredge D travels to the top of the drum 20 during rotation. Three arcuate cams or guides 86 are fixed in a cantilever manner at one end to an arcuate shield or dredge ramp 88 whose leading edge 88*a* contacts the large drum cylinder 29 at the top of the drum rotation. The shield or ramp 88 bears side plates 89 at opposed lateral edges thereof such that the dredge material is forced to ride up on the leading edge 88*a* of ramp 88 as the drum cylinder 29 rotates, the edge 66*d* of each blade 66 contacting the cams or guides 86 of the ramp to force the blades 66 radially inward and to retract the same within the large drum cylinder 29 through the transversely extending narrow drum cylinder slots 29*a* at circumferentially spaced locations within drum cylinder 29, said slots 29*a* being aligned with the spaces between guide plates 64 at respective sides of the drum.

In order to properly control the movement of the blade assemblies 68 and to effect movement of the main and auxiliary bucket plates from their right angle position to in-line position (shifting from FIG. 7 to FIG. 6) near the top of drum rotation, the drum cylinder 29 bears adjacent the slots 29*a* elongated rollers 90 which are preferably mounted for rotation about their axes and are positioned such that main bucket plate 72 rides down and over a roller 90 during retraction to cause bucket plate 72 to move into alignment with the blade 66 carrying the same and forcing the auxiliary bucket plate 74 to move into an overlying but generally parallel position, as seen in FIG. 6. This acts to close the bucket B, while as mentioned previously, it is the contact of the blade 66 with the sea bed S' that causes the dredge D being scraped thereby to press against the front of the bucket plate and to open the bucket plates 72, 74, to the position shown in FIG. 7.

Each of the blades 66 bear a plurality of bolts or stops 67 which extend in a longitudinal line across the blades, and radially interior of the slots 70 which pivotably support the bucket plates 72 and 74. When the blades are forced outwardly as result of biting into the sea bed, their radial projection is limited by the bolts or stops 67 contacting the elongated rollers 90 to each side of the blades inside the larger diameter cylinder 29 which rollers 90 also function to collapse the bucket B as the blades 66 move inwardly towards the axis of rotation of drum 20. It is noted in FIG. 5, that the bolts or stops 67 project through plate 66 with portions on each side thereof. By removing bolts 67, the blade 66 can be removed.

The dredge D which is deposited on the shield, hood or dredge ramp 88 (where the edge 88*a* makes contact with the periphery of the drum cylinder 29), the dredge material then being forced in a direction towards the front of the barge 14, where it falls, partially by gravity, onto a chute or channel member 92 which extends across the drum 20 from one side 28 to the other. Chute 92 includes an extension portion 92*a*, FIG. 1, leading to the side of barge opening 12 for deposit or further transport of the dredged material. Preferably, the channel member of chute 92 is inclined from one end to the other so that the material moves partially by gravity with a sliding motion down the chute or channel 92 to a position to one side of the rotating drum 20. For instance, the channel 92 may be supported by three vertical posts (not shown) attached to the frame with three holes provided within each post; if the channel support is locked in the top hole, the channel will unload forward. If locked in the top hole right post, bottom hole left post, it will unload on one side; reversed, it will unload on the opposite side. The number of blades bearing the bucket plates may vary, there being eight shown. However, the number may be six, four or even more than eight. While a pivot axle or shaft may extend completely through the drum, separate shaft portions or stub axles are shown as welded to the small diameter cylinder 60 at each end of that cylinder to fixedly position the cylinder 60 eccentric to the axis of the larger rotating outer drum cylinder 29.

In operation, the barge 14, which may be power driven or sail driven is moved forwardly in the direction of the arrow 19, and this movement itself may rotate the drum 20 and achieve a dredging operation. However, in the illustrated embodiment, the drum drive motor 48 positively rotates the drum 20 by way of chain 56 and the large diameter driven sprocket 32. The operation is automatic. The structure is simple and there are a minimum number of moving parts. It should be noted that the rotation of the large cylinder 29 of the drum 20 is in the same direction the barge is moving. Thus, the dredging system requires less energy to operate. As a matter of fact, the movement of the tide may be utilized. Alternatively, a small outboard motor could move the barge 14 forwardly to roll the large cylinder 29. The open, rectangular frame 15 may be locked in by means of the bolts 42 to insure a dig of just a few inches to an exact number of feet. Alternatively, the frame 15 could remain unlocked by allowing the blades 66 to dig their normal depth as the drum 20 is pushed toward by the force of movement of the barge. The moving parts essentially comprise the large drum 20 rotating in a forward direction relative to barge movement on the stub axles 22, the blades 66 moving in and out radially of the drum cylinder 29 and the buckets B opening and closing, i.e. movement of main bucket plates 72 and auxiliary bucket plates 74. While not shown, one end 28 of the cylinder is preferably bolted or otherwise fastened for ease of assembly and disassembly of the drum components.

Referring to FIG. 9, there is shown an alternate form or embodiment of the invention, wherein like elements bear like numerical designations. In this case, the barge 14 bears the rotation drum 20 at the front of the barge with the drum rotating in the direction of arrow 62 and being provided with a number of blade assemblies 68, all of which is in the identical fashion of the prior discussed embodiment. However, in this case, instead of having lift beams 34 at both ends of the crossbeams 16, 18, the means for mounting the drum for rotation about a horizontal axis and for raising and lowering the drum relative to the underlying sea bed, is effected only at one side of the apparatus. In this case, a vertical rail 36 is mounted to barge 14 at each side of the drum 20, by means of inclined or diagonal struts 100. The schematic representation of FIG. 9 does not include the winches for lifting the lift beam 34 on the rails 36 to each side of the drum as in the previously illustrated embodiment, although such means are identically employed in this embodiment. Further, a second diagonal strut at 102 is fixed at one end to each lift beam 34 and at its opposite end to a given crossbeam, in the vicinity of stub axle 22. A support frame as at 50 supports drive motor 48 in this embodiment, and a chain 54 leads from a motor sprocket (not shown) to a second sprocket 32 operatively fixed to drum 20 so as to drive the drum in a manner identical to that of the first embodiment.

The apparatus is further provided with cams 86 acting as extensions of the shield, hood or ramp 88 to forcibly collapse the buckets B and to insure deposit of the dredge D onto the conforming curved surface of the shield 88 for transport into the channel member 92 in an identical fashion to that of the prior described embodiment. In all respects, the operation is the same. The exception here is that rectangular frame assembly 15, formed partially by the laterally opposed crossbeams 16 and 18, is raised and lowered by paired laterally opposed lift beams 34 at one end of that frame 15 and by means mounted to the bow of the barge 14 bearing the dredge apparatus.

While the invention has been particularly shown and described with reference to preferred embodiments thereof, it will be understood by those skilled in the art that the foregoing and other changes in form and details may be made therein without departing from the spirit and scope of the invention.

What is claimed is:

1. In a rotary drum type dredging apparatus for mounting to a floating barge or the like, said apparatus comprising:

a generally rectangular horizontal open frame, a drum mounted within said frame for rotation horizontally about its axis with its lower end immersed within the sea, said drum bearing radially projectable and retractable dredging blades extending longitudinally of said drum at right angles to the direction of barge and drum movement through the sea and at circumferentially spaced positions about the drum periphery, the ends of said blades being projectable from said drum periphery beneath the water to cut into an underlying sea bed to pick up dredge during drum rotation and being retractable into said drum interior after emerging from the water and to permit the dredge to be removed from the drum periphery upon full retraction of the blades, the improvement wherein:

said drum is rotated in the direction of barge movement, each blade bears an elongated rectangular slot intermediate of its radially inner and outer ends and being exposed during blade end projection from the drum, a pair of oppositely directed elongated rectangular bucket plates hinged respectively along one edge thereto to the opposed longitudinal edges of said blade slots, and means for loosely linking the other, free longitudinal edges of said bucket plates such that during drum rotation, with the ends of said blades projecting from the drum periphery and said bucket plates exposed, said bucket plates move from positions where said plates generally overlie each other to close off the slots to positions where said bucket plates are generally at right angles to each other to form an open bucket during blade contact with the sea bed for forcible pick up of excavated dredge material and to carry it forwardly in the direction of drum rotation about the periphery of the drum to a position above the level of the sea.

2. The rotary drum type dredging apparatus as claimed in claim 1, wherein said bucket plates bear narrow transverse slots at right angles to the hinge pivot axis, the other of said bucket plates bearing arms projecting from the free end thereof which project through said transverse slot, respectively, said arms bearing at least one roller to the lateral side of said arms for contact with the surface of said one bucket plate adjacent said transverse slots; thereby forming said loose linking means between said bucket plates and said transverse slots, and said arms being dimensioned such that said arms travel from one end of said transverse slots to the other to permit the bucket plates to move from parallel overlapping position to a generally right angle bucket forming position, said buckets facing forwardly in the direction of rotation of said drum.

3. The rotary drum type dredging apparatus as claimed in claim 2, wherein one of said bucket plates is of a transverse width which is slightly less than the full width of the elongated blade slots carrying said bucket plates, and the other bucket plate is of a transverse width on the order of one-half said elongated slot width, such that said bucket plates are essentially at right angles to each other, when in open bucket position.

4. The rotary drum type dredging apparatus as claimed in claim 1, wherein said drum is formed of a large diameter cylinder, said cylinder is provided with narrow, elongated longitudinal slots at spaced circumferential positions through which the blades project and retract, and said large diameter cylinder carries on its inner surface rollers adjacent said slots on at least the downstream side of said slots in the direction of drum rotation such that said rollers cam said bucket plates from open bucket to closed bucket position during transaction of said blades into the interior of said drum.

5. The rotary drum type dredging apparatus as claimed in claim 4, further comprising a plurality of pairs of closely spaced blade guide plates radially fixed within the interior of the large diameter cylinder forming said drum at opposite sides thereof, and wherein said blades are of a length such that opposed ends of said blades are positioned between given pairs of guide plates for guiding said blades into and out of said drum.

6. The rotary drum type dredging apparatus as claimed in claim 5, further comprising a small diameter cylinder fixedly mounted to said frame assembly interiorly of said rotating drum eccentric to the axis of rotation of said drum and extending longitudinally between said blade guide plates at opposite ends of said drum and being eccentric in a downwardly and rearwardly direction relative to the direction of movement of the drum such that during rotation of the drum, the blades are forcibly moved to a projected position while submerged and are permitted full retraction during a portion of drum rotation subsequent to emergence from the sea.

7. The rotary drum type dredging apparatus as claimed in claim 6, further comprising at least one stop borne by said blades on the side of said blades facing said elongated rollers, said at least one stop being radially inward of the slots bearing said bucket plates such that said blades are limited in their projections from said elongated longitudinal slots on the large diameter drum cylinder to the extent where said bucket plates are exposed.

8. The rotary drum type dredging apparatus as claimed in claim 6, further comprising an arcuate dredge ramp fixed to said frame and overlying said drum cylinder in the quadrant opposite that of said small diameter cylinder, said arcuate ramp terminating in a leading edge relative to the direction of rotation of said drum which contacts the drum cylinder periphery at a point along the top of said drum cylinder for scraping removal of dredged material deposited on the periphery of said drum cylinder during retraction of said blades, and wherein said apparatus further comprises at least one curved camming bar extending outwardly from said dredge ramp leading edge, beyond the leading edge thereof and being spaced from the periphery of said drum cylinder such that during rotation of said drum, the radially outer edge of said blades contact the bottom of said camming bar to forcibly drive said blades radially inward into drum retracted position to effect deposition of the dredge material first onto the drum cylinder periphery and then onto said dredge ramp, and wherein said apparatus further comprises an elongated channel extending along the side of said dredge ramp over the length of the same and acting to receive the dredge material to cause accumulated dredge material to move transversely to one side of said drum.

9. The rotary drum type dredging apparatus as claimed in claim 4, further comprising at least one stop borne by said blades on the side of said blades facing said elongated rollers, said at least one stop being radially inward of the slots bearing said bucket plates such that said blades are limited in their projections from said elongated longitudinal slots on the large diameter drum cylinder to the extent where said bucket plates are exposed.

10. The rotary drum type dredging apparatus as claimed in claim 1, wherein said generally rectangular horizontal frame comprises laterally spaced parallel crossbeams, bearing means intermediate of the ends of said crossbeams for supporting said drum for rotation about its axis, lift beams mounted at right angles respectively to at least one end of said crossbeams, vertical rails fixed to said barge and slidably receiving said lift beams, means for raising and lowering said lift beams within said rails, transverse holes within said lift beams and said rails respectively and locking bolts insertable within aligned holes in said lift beams and said rails to lock said lift beams at given varying vertical height positions to thereby establish fixedly the immersion depth of said drum and the relative dredging ability of said blades projectable from the drum periphery.

* * * * *